US008905662B2

(12) United States Patent
Richards et al.

(10) Patent No.: US 8,905,662 B2
(45) Date of Patent: Dec. 9, 2014

(54) METHOD FOR ACQUIRING AND TRANSPORTING MULTIPLE-ITEM SETS USING A VACUUM SYSTEM

(75) Inventors: Paul N. Richards, Fairport, NY (US); Derek A. Bryl, Webster, NY (US); Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 458 days.

(21) Appl. No.: 13/210,435

(22) Filed: Aug. 16, 2011

(65) Prior Publication Data

US 2013/0042733 A1 Feb. 21, 2013

(51) Int. Cl.

| | |
|---|---|
| ***B26D 5/04*** | (2006.01) |
| ***B26D 9/00*** | (2006.01) |
| ***B26F 1/02*** | (2006.01) |
| *B26D 7/32* | (2006.01) |

(52) U.S. Cl.

CPC ..... *B26D 9/00* (2013.01); *B26D 2007/322* (2013.01); *B26F 1/02* (2013.01)

USPC ..... 400/621; 156/250; 83/24; 83/100; 216/4

(58) Field of Classification Search

CPC ..... B41J 11/66; B41J 11/663; B26D 7/32

USPC ..... 150/250; 216/4; 83/24, 100; 400/621; 156/250

See application file for complete search history.

(56) References Cited

U.S. PATENT DOCUMENTS

| | | | | |
|---|---|---|---|---|
| 2,667,420 | A | 1/1954 | Meulemans et al. | |
| 4,799,722 | A | 1/1989 | Marzinotto | |
| 5,192,623 | A | 3/1993 | Gewelber | |
| 5,899,449 | A | 5/1999 | Acquaviva et al. | |
| 6,032,004 | A | 2/2000 | Mirabella, Jr. | |
| 7,250,092 | B2 * | 7/2007 | Ferrell | 156/252 |
| 2002/0045024 | A1 | 4/2002 | Wise | |
| 2004/0100009 | A1 | 5/2004 | Bindon et al. | |
| 2005/0051263 | A1 * | 3/2005 | Ferrell | 156/250 |

FOREIGN PATENT DOCUMENTS

| | | |
|---|---|---|
| EP | 0844203 A2 | 5/1998 |

* cited by examiner

*Primary Examiner* — David Banh

(74) *Attorney, Agent, or Firm* — Gibb & Riley, LLC

(57) ABSTRACT

Methods and devices include a patterning device positioned along a processing path. The patterning device forms one or more holes through workpieces at a contact location of the workpieces. A transport device is positioned along the processing path. The transport device removes the workpieces from the processing path and stacks the workpieces by simultaneously moving at least two of the workpieces together in workpiece sets. The transport device comprising a vacuum device that contacts the contact location of the top workpiece within each of the workpiece sets. The vacuum device applies vacuum through the holes of the top workpiece to the bottom workpiece within each of the workpiece sets to maintain the workpieces together in the workpiece sets when performing the removing and the stacking.

20 Claims, 3 Drawing Sheets

METHOD FOR ACQUIRING AND TRANSPORTING MULTIPLE-ITEM SETS USING A VACUUM SYSTEM

BACKGROUND

Embodiments herein generally relate to moving and stacking operations, and more particularly to patterning openings in workpieces that are output on a transport belt of a production device, and using a vacuum operated picker to simultaneously pick up and move multiple workpieces to a stacking unit.

Advances in production machinery can provide flexible systems that can collect, compile and stack, cards, signage and packaging products of multiple sizes and shapes. For example, some media handling systems utilize vacuum cups to acquire and securely transport single cards/sheets from one point to another. When multiple items are stacked, the stack cannot be moved reliably by applying the vacuum cup only to the top sheet. More specifically, the vacuum cup will only remove the top piece from the stack and will not move the entire stack.

One way to move multiple items in sets is to clamp/secure the cards from the side and/or bottom. This presents several challenges including how to clamp cards of drastically different shapes with the same end effectors or tool. An additional challenge is gripping, transporting, and depositing a stack of workpieces into a stacking device, because gripping mechanisms used to move sets are complex and tend to interfere with the final stacking function.

SUMMARY

An exemplary sign processing apparatus herein has a media supply supplying media to a media path, and a printing engine positioned along the media path. The printing engine prints marks on the media. Further, a cutter is positioned along the media path, and the cutter divides (cuts) the media into individual workpieces, such as cards, signs, etc. Also, a patterning device is positioned along the media path, and the patterning device forms one or more holes through each of the signs at an area of the signs sometimes referred to herein as a "contact location." Different holes can have different diameters. The contact location is a portion of the signs that will be subsequently covered or disguised by some other additional item, such as a sticker, a crease, a fold, another portion of the sign, etc. The cutter and the patterning device can be combined into a single device or can be separate devices. Further, the printing engine, cutter, and patterning device can be positioned in any order along the media path.

A picking device (sometimes referred to herein as a "picker" or "transport device") is additionally positioned along the media path. The transport device removes the signs from the media path and stacks the signs into stacks. With embodiments herein, the transport device simultaneously moves at least two of the signs together in stacks called sign sets when forming the stacks. The transport device has at least one vacuum device that contacts the contact location of the top sign within each of the sign sets. The vacuum device has a size and shape sufficient to cover and provide suction to at least all of the contact location. All of the holes can be located within the area called the "contact location." The vacuum device applies vacuum through the holes of the top sign to the bottom sign within each of the sign sets, such that the vacuum alone maintains the signs together in the sign sets (when performing the removing and the stacking processes).

The patterning device forms the holes in different locations on individual signs within the sign sets such that some of the holes of the individual signs within each of the sign sets are aligned and others of the holes of the individual signs within each of the sign sets are not aligned. Also, the top sign and the bottom sign are on opposite ends of each of the sign sets, and each of the sign sets includes an opening formed from aligned holes that run the entire distance between the top sign and the bottom sign within each of the sign sets. Additionally, middle signs can be between the top sign and the bottom sign, and the patterning device forms the holes, when aligned in the sign sets, to create continuous openings extending from the top sign down to the bottom sign and to each of the middle signs, such that the vacuum is applied through at least one of the continuous openings to a continuous surface (a continuous surface does not have any holes or openings) of the top sign, the bottom sign, and the middle signs.

An exemplary method herein patterns one or more holes through workpieces moving along a processing path. The holes are formed at a contact location of the workpieces and are formed using a patterning device. The method removes the workpieces from a processing path using a transport device to simultaneously move at least two of the workpieces together in workpiece sets. The method removes the workpiece sets by using a vacuum device of the transport device that contacts the contact location of the top workpiece within each of the workpiece sets. By using the vacuum device to apply vacuum through the holes of the top workpiece to a continuous surface of the bottom workpiece within each of the workpiece sets, the vacuum alone maintains the workpieces together in the workpiece sets. The workpieces sets are stacked into stacks using the transport device.

The patterning process calculates the locations of the holes such that some of the holes of the individual workpieces within each of the workpiece sets are aligned and others of the holes of the individual workpieces within each of the workpiece sets are not aligned. The top workpiece and the bottom workpiece are on opposite ends of each of the workpiece sets, and the patterning is performed such that the holes of the top workpiece and the bottom workpiece within each of the workpiece sets are not aligned and some of the holes of other workpieces are aligned. Middle workpieces can be between the top workpiece and the bottom workpiece, and the patterning process calculates to form the holes such that, when aligned in the workpiece sets, the holes create continuous openings extending from the top workpiece down to the bottom workpiece and to each of the middle workpieces, and such that the vacuum is applied through at least one of the continuous openings to a continuous, unbroken surface of each of the bottom workpiece and the middle workpieces.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
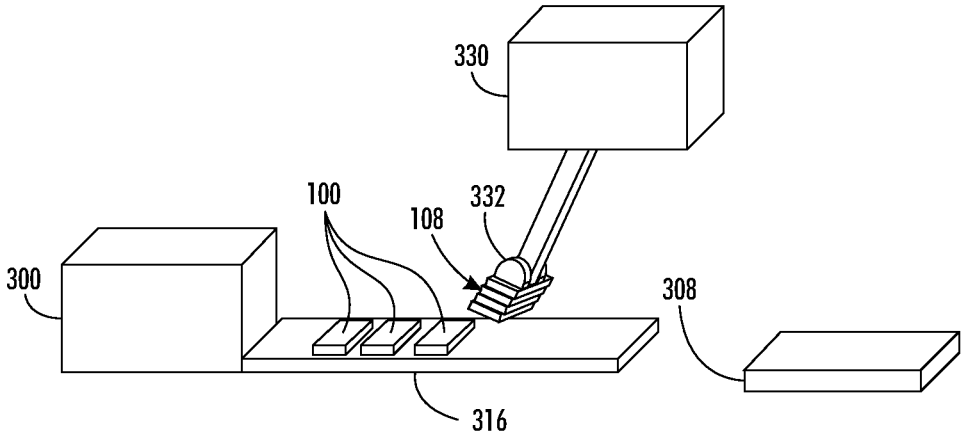
FIG. 1 is a perspective view schematic diagram of a device according to embodiments herein.

As mentioned above, when moving multiple items in stacks it is difficult to clamp/secure the items from the side and/or bottom. This is made more difficult when there is a need to grab and move drastically different shapes with the same end effectors or tool (one example of an end effectors is a vacuum cup). An additional challenge is providing complex end effectors that are capable of gripping, transporting and depositing a stack of workpieces into a stacking device, because gripping mechanisms used to move stacks are complex and tend to interfere with the final stacking function Therefore, the embodiments herein allow the acquisition of multiple items with a combination of a vacuum cup technology and item design. The embodiments herein pattern thru holes into the workpieces to allow the vacuum force to be applied to all items in a stack, not just the top workpiece. This allows for acquisition of multiple items with a single pick. More specifically, this disclosure describes that die cutting, laser cutting, etc., processes can be used to add any size patterned holes (or slots) to enable air flow for multiple picking of items such as store signage and packaging products. This disclosure presents a combination of elastomeric vacuum cups and a vacuum system to acquire multiple items in a stack. The system (vacuum cup/perforated item combination) is used to secure and transport items without dropping the items or affecting the stack registration.

While it is common to use vacuum cup technology to acquire and transfer sheets or items within printing, mailing and sorting systems, the use of vacuum cup systems is limited to acquiring only one item per pass of the system, because the vacuum cup can only apply a pressure differential to the top item. Any items below that top item cannot be acquired. In fact, conventional systems concentrate their development efforts on providing systems that will consistently only select the top item from a stack, without simultaneously selecting the next item. The inadvertent selection of more than the top item from the stack (when the system is intended to only select in the top item) can cause many problems, including jams, registration issues, etc. Because vacuum operated picking mechanisms only select the top item from a stack, conventional media handling designs rely on downstream stacking mechanisms that take singulated items and place them into sets and stacks. This conventional process requires multiple handling operations which adds complexity/cost to a system, and creates opportunities for registration and handling errors.

To the contrary, the present disclosure provides vacuum picking systems and methods that can collect and collate multiple signage/packaging products in one process step, compared to the multiple motion and mechanical steps required in conventional vacuum picking systems.

More specifically, with the embodiments herein, holes are cut to a desired pattern. The hole pattern from item N to item N+1 can be random, and can be designed to meet aesthetic requirements or to be hidden in an area that will be subsequently covered in, for example, a fold cut (½ thru cut enabling a fold operation) if visual concealment is required. The holes (orifices) allow air flow (negative pressure) thru the media to permit collection of multiple items at one time. This collection method enables robotic multiple picking and compiling without additional compiling steps downstream of the finishing process. This enables increased processing speeds and eliminates the need for additional mechanical and electrical hardware.

Thus, the embodiments herein allow acquisition of a multi-item set with a vacuum cup system, transportation of the multi-item set, placement of the item set on another item set without a traditional bottom mechanical clamp that typically disturbs the stack upon removal. The embodiments herein eliminate hardware and complexity, lowering cost relative to a traditional stack clamp/gripper, and allow the item set acquisition at any location, whereas a conventional clamp is edge gripped and would need more clearance. Further, the embodiments herein provide an extremely versatile system, that accommodates constantly changing product shapes and reduces or eliminates setup between jobs. Therefore, the embodiments herein optimize media handling.

Figure 5:
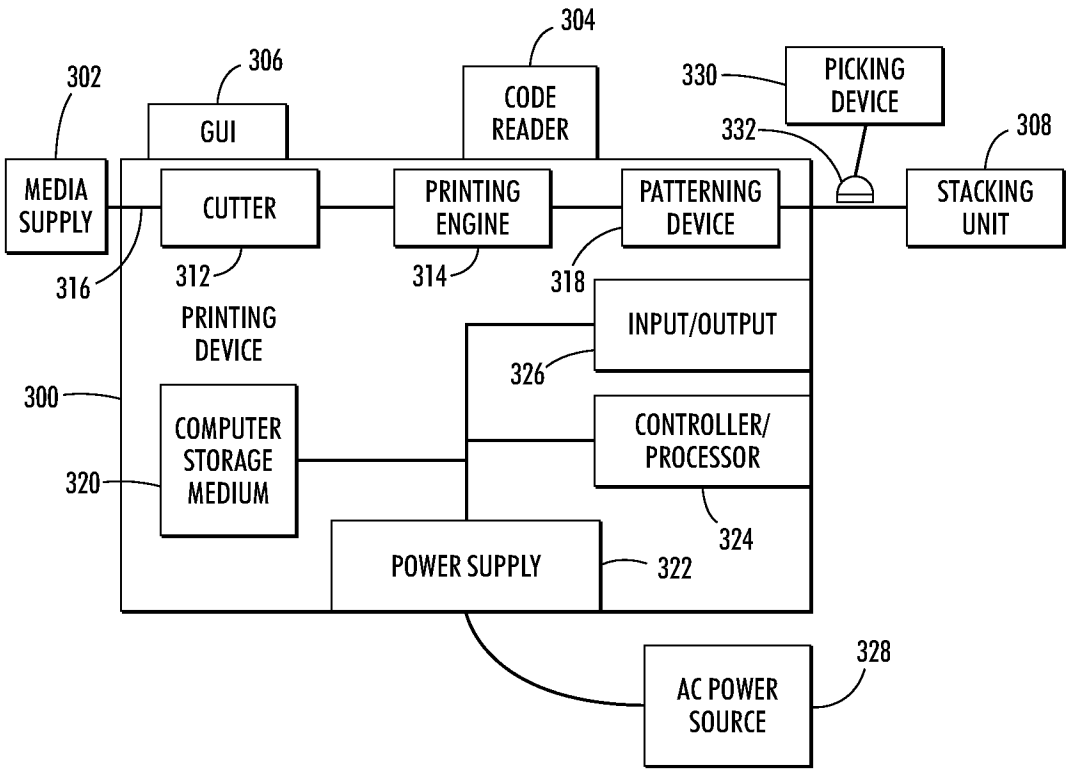
FIG. 5 is a side-view schematic diagram of a device according to embodiments herein.

Referring now to the drawings, and more specifically to FIGS. 1 and 5, an exemplary sign processing apparatus 300 herein has a media supply 302 supplying media to a media path 316, and a printing engine 314 positioned along the media path 316. The printing engine 314 prints marks on the media. Further, a cutter 312 is positioned along the media path 316, and the cutter 312 divides (cuts) the media into individual workpieces 100, such as signs.

While signs are used as an example of the type of workpiece that can be processed with the embodiments herein, those ordinarily skilled in the art understand that virtually any form of workpiece that can be stacked could be used with the disclosed structures and methods, and the claims are not limited only to signs. Therefore, signs, sheets of paper, cards, pieces of plastic, etc., as well as many other items could be the workpieces processed by the embodiments herein.

A patterning device 318 is positioned along the media path 316. The cutter 312 and the patterning device 318 can be combined into a single device or can be separate devices, depending upon the specific configuration. Further, the printing engine 314, cutter 312, and patterning device 318 can be positioned in any order along the media path 316, and the order shown is purely arbitrary.

One of the features of the embodiments herein is that the patterning device 318 calculates the position of and forms the holes 102 in different locations on individual signs 100 such that some of the holes 102 of the individual signs 100 within each of the sign sets 108 are aligned and others of the holes 102 of the individual signs 100 within each of the sign sets 108 are not aligned.

A picking device 330 (sometimes referred to herein as a "picker" or "transport device") is additionally positioned along the media path 316. The transport device 330 stack the signs 100, removes the signs 100 from the media path 316, and places the stacked signs 100 into a stacking device 308.

Figure 2:
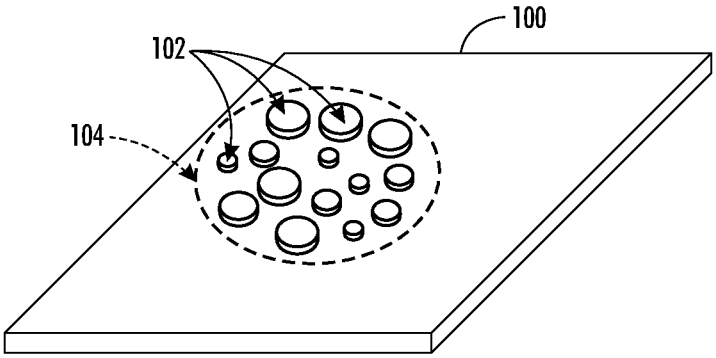
FIG. 2 is a perspective view schematic diagram of a workpiece according to embodiments herein.

As shown in FIG. 2, the patterning device 318 forms one or more holes 102 through each of the signs 100 at an area 104 of the signs 100 sometimes referred to herein as a "contact location." This area 104 is referred to as the contact location because this is the location where the suction cup will contact the workpiece 100. As illustrated, different holes 102 can have different diameters. The contact location 104 of the signs 100 may be subsequently covered or disguised by some other additional item, such as a sticker, a crease, a fold, another portion of the sign, etc.

With embodiments herein, the transport device 330 simultaneously moves at least two of the signs 100 together in stacks 108. Such stacks 108 of workpieces 100 are sometimes referred to herein as "sign sets." The transport device 330 has at least one vacuum device 332 that contacts the contact location 104 of the top sign within each of the sign sets 108.

Figure 3:
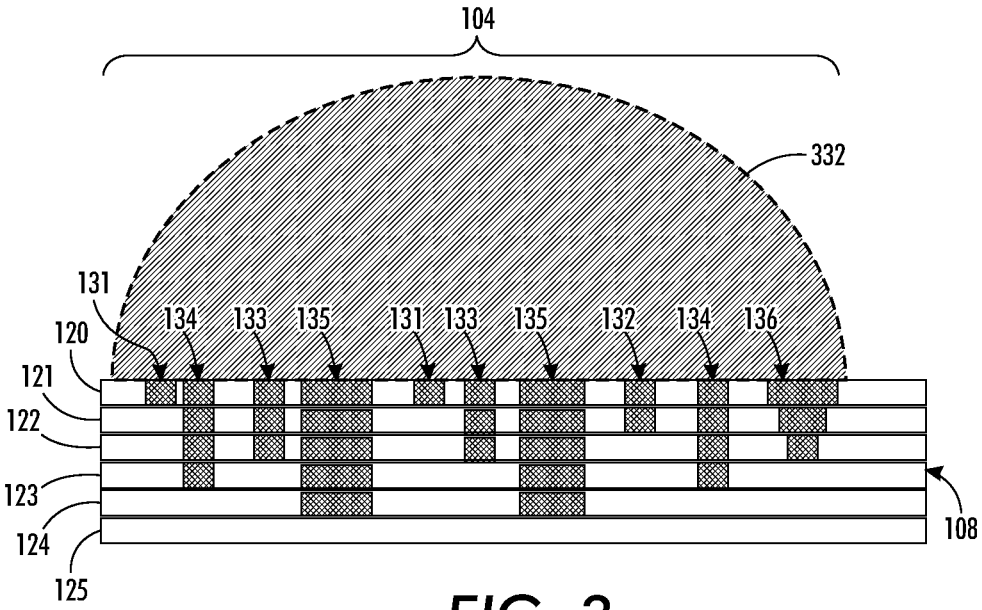
FIG. 3 is a side-view schematic diagram of a stack of workpieces according to embodiments herein.

In operation, the transport device 330 positions the vacuum device 332 over a first one of the workpieces 100, that will arbitrarily up be referred to as a top workpiece. Note that, as shown in FIG. 3, the top workpiece is shown as item 120, the bottom workpiece is item 125, and workpieces 121-124 are the middle workpieces. After acquiring the top workpiece 120, the transport device 330 then positions the vacuum device 332 over another workpiece that is lying on the media path 316. In FIG. 3, this is shown as the middle workpiece 121. The vacuum force created by the vacuum device 332 draws in air through some of the holes 102 in order to apply vacuum to the middle workpiece 121.

More specifically, as shown in FIG. 3, holes 131 (which are unique to the top workpiece 120) allow the vacuum force from the vacuum device 332 to be applied against the continuous unbroken area of the middle workpiece 121, as shown in FIG. 3. This vacuum force maintains the middle workpiece 121 against the bottom surface of the top workpiece 120.

Subsequently, the transport device 330 positions the vacuum device 332 over another workpiece 100 that is lying on the media path 316 (this is middle workpiece 122, shown in FIG. 3). The vacuum force passes through openings 132 (which are unique to top workpiece 120 and middle workpiece 121) and applies vacuum pressure against a continuous unbroken area of the middle workpiece 122, as shown in FIG. 3.

After this, the transport device 330 continues to position the vacuum device 332 over subsequent workpieces until a set of workpieces 108 is stacked together and maintained on the vacuum device 332 (as shown in FIG. 1). As shown in FIG. 3, certain ones of the holes 102 align to form openings 131-135 that cause the vacuum force to be applied to a continuous unbroken (potentially flat) area of each and every workpiece 120-125 in the set 108. The different patterns of holes 102 that are formed in each of the workpieces 120-125 combine to creates unique openings 131-135 that can apply the vacuum force to a continuous unbroken (potentially flat) area of each and every workpiece 120-125 in the set 108.

As shown more specifically in FIG. 3, the arbitrarily named top sign 120 and bottom sign 125 are on opposite ends of the sign sets 108. Each of the sign sets 108 includes openings 131-135 formed from aligned holes 102 that run the entire distance between the top sign 120 and the bottom sign 125 within each of the sign sets 108. The middle signs 121-124 are between the top sign 120 and the bottom sign 125, and the patterning device 318 forms the holes 102, when aligned in the sign sets 108, to create continuous openings 131-135 that extend from the top sign 120 down to the bottom sign 125 and to each of the middle signs 121-124, such that the vacuum is applied through at least one of the continuous openings 131-135 to a flat continuous, unbroken surface of the top sign 120, the bottom sign 125, and the middle signs 121-124.

Note that the bottom sign 125 may not include any holes 102 (although, in certain embodiments, the bottom sign 125 could include holes). Thus, the signs toward the top of the stack (signs 120-122) would have more and potentially larger holes than the signs toward the bottom of the stack (signs 123-125). Also, FIG. 3 illustrates that the holes 102 may have different sizes and/or shapes. For example, the holes 102 that align to form the longer and deeper openings 135 may be formed larger to allow more vacuum force to reach deeper into each set 108. Further, different combinations of hole sizes between signs can form tapered continuous openings 136.

The vacuum device 332 has a size and shape sufficient to cover and provide suction to at least all of the contact location 104 and is illustrated in FIG. 3 partially transparent and using dashed lines to avoid obscuring other features shown in FIG. 3. As shown, all of the holes 102 are located within the area called the "contact location 104." The vacuum device 332 applies vacuum through the holes 102 of the top sign 120 to the bottom sign 125 within each of the sign sets 108, such that the vacuum alone maintains the signs 100 together in the sign sets 108 (when performing the removing and the stacking processes). Each contact location of each sign includes holes and continuous surface area. Again, the continuous surface area is unbroken and flat and does not contain holes or other openings. The continuous surface area is sufficiently large (as a percentage of the contact location) to allow the vacuum force to hold the sign against the vacuum cup. Thus, only the vacuum force supplied by the vacuum device 332 holds the set of workpieces 108 together in a stack, and no other clamping or grabbing mechanisms are utilized.

Figure 4:
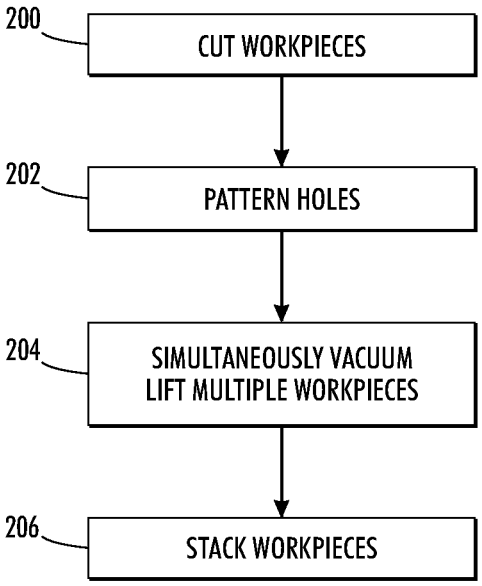
FIG. 4 is a flow diagram illustrating aspects of various method embodiments herein.

FIG. 4 is flowchart illustrating exemplary methods herein. In item 200, the method cuts the media into individual workpieces. Then, this method calculates and forms patterns of holes through workpieces moving along a processing path in item 202. The holes are formed at a contact location of the workpieces and are formed using a patterning device.

In item 204, the method removes the workpieces from a processing path using a transport device to simultaneously move at least two of the workpieces together in workpiece sets. The method removes the workpiece sets by using a vacuum device of the transport device that contacts the contact location of the top workpiece within each of the workpiece sets. By using the vacuum device to apply vacuum through the holes of the top workpiece to the bottom workpiece within each of the workpiece sets, the vacuum alone maintains the workpieces together in the workpiece sets. The workpieces sets are stacked into stacks using the transport device in item 206.

The patterning process 202 is performed such that some of the holes of the individual workpieces within each of the workpiece sets are aligned and others of the holes of the individual workpieces within each of the workpiece sets are not aligned. The top workpiece and the bottom workpiece are on opposite ends of each of the workpiece sets, and the patterning is performed such that the holes of the top workpiece and the bottom workpiece within each of the workpiece sets are not aligned and some of the holes of other workpieces are aligned. Middle workpieces can be between the top workpiece and the bottom workpiece, and the patterning process forms the holes such that, when aligned in the workpiece sets, the holes create continuous openings extending from the top workpiece down to the bottom workpiece and to each of the middle workpieces, and such that the vacuum is applied through at least one of the continuous openings to a continuous, unbroken surface of each of the bottom workpiece and the middle workpieces.

Referring again to FIG. 5, more specifically, what is illustrated is a computerized device 300, which can be used with embodiments herein. The device 300 includes a controller/processor 324, and the marking device (printing engines) 314 is operatively connected to the processor 324, the media path 316 is positioned to supply media from the media supply 302 to the marking device(s) 314, and a communications port (input/output) 326 is also operatively connected to the processor 324 and to a computerized network external to the device. The media path 316 can comprise any combination of belts, rollers, nips, drive wheels, vacuum devices, air devices, etc. Also, the device 300 can include at least one accessory functional component (such as a scanner/document handler 304, sheet supply 302, etc.) and a graphic user interface assembly 306 that also operates on the power supplied from the external power source 328 (through the power supply 322).

The input/output device 326 is used for communications to and from the multi-function device 300. The processor 324 controls the various actions of the device. A non-transitory computer storage medium device 320 (which can be optical, magnetic, capacitor based, etc.) is readable by the processor 324 and stores instructions that the processor 324 executes to allow the multi-function device to perform its various functions, such as those described herein.

Thus, a body housing 300 has one or more functional components that operate on power supplied from the alternating current (AC) 328 by the power supply 322. The power supply 322 connects to an external alternating current power source 328 and converts the external power into the type of power needed by the various components.

As would be understood by those ordinarily skilled in the art, the device 300 shown in FIG. 5 is only one example and the embodiments herein are equally applicable to other types of devices that may include fewer components or more components. For example, while a limited number of printing engines and paper paths are illustrated in FIG. 5, those ordinarily skilled in the art would understand that many more paper paths and additional printing engines could be included within any device used with embodiments herein.

In one example, the transport device 330 can comprise a computerized spider robot device. Such a device can very precisely locate the vacuum device 332 to cause all items within a given set 108 to be very precisely aligned in a stack. Further, as different jobs are processed by the manufacturing device 300, the size and shape of the workpieces 100 will change. In addition, the location of such workpieces 100 on the media path 316 can also vary from job to job.

The processor 324 automatically controls the transport device 330 to accommodate for these differences because the transport device 330 is in communication with the processor 324. Therefore, the manufacturing device 300 can alter the locations to which the transport device 330 will apply a vacuum device 332 and the amount of vacuum that is applied, depending upon the specific thickness, size, shape, and locations of the different workpieces 100 that are produced by the different jobs processed by the manufacturing device 300. Similarly, the manufacturing device 300 and the transport device 330 are in communication with the stacking device 308, which allows the transport device 330 to precisely comply with the requirements of the stacking device 308 when placing the sets of workpieces 108 in the stacking device 308.

Each different job is supplied to the manufacturing device 330 through the input-output 326. The job description includes not only instructions to the cutter 312 (regarding the size and shape of the workpieces to be produced) and to the printing engine 314 (regarding what is to be printed on the workpieces); but also includes instructions regarding how many workpieces are to be stacked into each set, and how the sets are to be stacked in the stacking unit 308. Therefore, the processor 324 automatically reads the requirements of each different job, and automatically calculates the hole patterns that will be required and controls the patterning device 318 to form different patterns of holes 102 in the different workpieces 100 that are output to the media path 316 so that the various openings 131-135 will be present when the workpieces are stacked into the sets 108. Similarly, the processor 324 controls the actions of the transport device 330 so that the workpieces 100 are selected in the correct order and are positioned properly so that the various openings 131-135 will be present when the workpieces are stacked into the sets 108.

In doing so, the embodiments herein eliminate the need for the user to perform set up operations before each different job is processed. Conventional setup operations require the user to program the picking devices so that they reach to the appropriate locations required by the specific output of the specific job (and the specific requirements of the different stacker units that could be involved). In addition, conventional setup operations can require that different end effectors or tools be attached to the ends of the picking devices, depending upon whether individual items or stacks of items are being picked from the transport belt. Further, if workpieces are to be grouped into sets, conventional systems require additional hardware that can group the workpieces into the sets.

Therefore, the systems and methods disclosed herein eliminate the need for such traditional hardware that can group workpieces into sets, and eliminate the need to perform setup operations between different jobs, thereby increasing productivity and user satisfaction. Thus, these embodiments can combine product picking and product stacking into one process or operation. These embodiments drastically reduce product compiling cycle time, additional compiling processes and additional mechanical equipment downstream in the compiling process needed to complete a final product stack. These embodiments have the ability/flexibility to function with any form of upstream product cutting (die cutting, laser cutting, etc.) or pre-cut product. These embodiments allow for "real time" or "on the fly" air flow orifice size and location changes. This enables multiple size and weight product picks. These embodiments allow multiple product shapes and sizes within one stack, within one pick and placement operation. These embodiments enable the orifice configurations to be configured as part of a product logo, water mark, etc. These embodiments also enable a wide range of vacuum cup and end effecter configurations.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim 1tself, steps or components of the embodiments herein cannot be implied or imported from any above example as limitations to any particular order, number, position, size, shape, angle, color, or material.

What is claimed is:

1. A sign processing apparatus comprising:

a media supply supplying media to a media path;

a printing engine positioned along said media path, said printing engine printing marks on said media;

a cutter positioned along said media path, said cutter dividing said media into individual signs;

a patterning device positioned along said media path, said patterning device forming one or more different patterns of holes through each of said signs; and a transport device positioned along said media path, said transport device removing said signs from said media path to stack at least two of said signs into sign sets, said transport device simultaneously moving said signs together in said sign sets, said transport device comprising a vacuum device that contacts the top sign within each of said sign sets, said vacuum device applying vacuum through said holes of said top sign to the bottom sign within each of said sign sets, such that said vacuum alone maintains said signs together in said sign sets; and said top sign and said bottom sign being on opposite ends of each of said sign sets and middle signs being between said top sign and said bottom sign, and said patterning device forming said different patterns of holes, when aligned in said sign sets, to create continuous openings extending from said top sign down to said bottom sign and to said middle signs, such that said vacuum is applied through at least one of said continuous openings to a continuous, unbroken surface of each of said bottom sign and said middle signs.

2. The sign processing apparatus according to claim 1, said patterning device forming said holes in different locations on individual signs within said sign sets such that some of said holes of said individual signs within each of said sign sets are aligned and others of said holes of said individual signs within each of said sign sets are not aligned.

3. The sign processing apparatus according to claim 1, said top sign and said bottom sign being on opposite ends of each of said sign sets, and each of said sign sets including an opening formed from aligned ones of said holes that runs the entire distance between said top sign and said bottom sign within each of said sign sets.

4. The sign processing apparatus according to claim 1, different ones of said different holes having different diameters.

5. A sign processing apparatus comprising:

a media supply supplying media to a media path;

a printing engine positioned along said media path, said printing engine printing marks on said media;

a cutter positioned along said media path, said cutter dividing said media into individual signs;

a patterning device positioned along said media path, said patterning device forming one or more different patterns of holes through each of said signs; and a transport device positioned along said media path, said transport device removing said signs from said media path to stack at least two of said signs into sign sets, said transport device simultaneously moving said signs together in said sign sets, said transport device comprising a vacuum device that contacts the top sign within each of said sign sets, said vacuum device have a size and shape sufficient to provide suction to said top sign, said vacuum device applying vacuum through said holes of said top sign to the bottom sign within each of said sign sets, such that said vacuum alone maintains said signs together in said sign sets; and said top sign and said bottom sign being on opposite ends of each of said sign sets and middle signs being between said top sign and said bottom sign, and said patterning device forming said different patterns of holes, when aligned in said sign sets, to create continuous openings extending from said top sign down to said bottom sign and to said middle signs, such that said vacuum is applied through at least one of said continuous openings to a continuous, unbroken surface of each of said bottom sign and said middle signs.

6. The sign processing apparatus according to claim 5, said patterning device forming said holes in different locations on individual signs within said sign sets such that some of said holes of said individual signs within each of said sign sets are aligned and others of said holes of said individual signs within each of said sign sets are not aligned.

7. The sign processing apparatus according to claim 5, said patterning device forming said holes in different locations on said top sign and said bottom sign within each of said sign sets, such that said holes of said top sign and said bottom sign within each of said sign sets are not aligned, said top sign and said bottom sign being on opposite ends of each of said sign sets.

8. The sign processing apparatus according to claim 5, different ones of said different holes having different diameters.

9. A sign processing apparatus comprising:

a supply supplying signs to a media path;

a patterning device positioned along said media path, said patterning device forming one or more different patterns of holes through each of said signs; and a transport device positioned along said media path, said transport device removing said signs from said media path to stack at least two of said signs into sign sets, said transport device comprising a vacuum device that contacts the top sign within each of said sign sets, said vacuum device applying vacuum through said holes of said top sign to the bottom sign within each of said sign sets, such that said vacuum maintains said signs together in said sign sets; and said top sign and said bottom sign being on opposite ends of each of said sign sets and middle signs being between said top sign and said bottom sign, and said patterning device forming said different patterns of holes, when aligned in said sign sets, to create continuous openings extending from said top sign down to said bottom sign and to said middle signs, such that said vacuum is applied through at least one of said continuous openings to a continuous, unbroken surface of each of said bottom sign and said middle signs.

10. The sign processing apparatus according to claim 9, said patterning device forming said holes in different locations on individual signs within said sign sets such that some of said holes of said individual signs within each of said sign sets are aligned and others of said holes of said individual signs within each of said sign sets are not aligned.

11. The sign processing apparatus according to claim 9, said patterning device forming said holes in different locations on said top sign and said bottom sign within each of said sign sets, such that said holes of said top sign and said bottom sign within each of said sign sets are not aligned, said top sign and said bottom sign being on opposite ends of each of said sign sets.

12. The sign processing apparatus according to claim 9, different ones of said different holes having different diameters.

13. A system comprising:

a patterning device positioned along a processing path, said patterning device forming one or more different patterns of holes through workpieces; and a transport device positioned along said processing path, said transport device removing said workpieces from said processing path to stack at least two of said workpieces into workpiece sets, said transport device simultaneously moving said workpieces together in said workpiece sets, said transport device comprising a vacuum device that contacts he top workpiece within each of said workpiece sets, said vacuum device applying vacuum through said holes of said top workpiece to the bottom workpiece within each of said workpiece sets, such that said vacuum alone maintains said workpieces together in said workpiece sets; and said top workpiece and said bottom workpiece being on opposite ends of each of said workpiece sets and middle workpieces being between said top workpiece and said bottom workpiece, and said patterning device forming said holes, when aligned in said workpiece sets, to create continuous openings extending from said top workpiece down to said bottom workpiece and to each of said middle workpieces, such that said vacuum is applied through at least one of said continuous openings to a continuous, unbroken surface of each of said bottom workpiece and said middle workpieces.

14. The system according to claim 13, said patterning device forming said holes in different locations on individual workpieces within said workpiece sets such that some of said holes of said individual workpieces within each of said workpiece sets are aligned and others of said holes of said individual workpieces within each of said workpiece sets are not aligned.

15. The system according to claim 13, said top workpiece and said bottom workpiece being on opposite ends of each of said workpiece sets, and each of said workpiece sets including an opening formed from aligned ones of said holes that runs the entire distance between said top workpiece and said bottom workpiece within each of said workpiece sets.

16. The system according to claim 13, different ones of said different holes having different diameters.

17. A method comprising:

patterning one or more different patterns of holes through workpieces moving along a processing path, said holes being formed using a patterning device;

removing said workpieces from a processing path to stack at least two of said workpieces into workpiece sets using a transport device to simultaneously move said workpieces together in workpiece sets, by using a vacuum device of said transport device that contacts the top workpiece within each of said workpiece sets, and by using said vacuum device to apply vacuum through said holes of said top workpiece to the bottom workpiece within each of said workpiece sets, such that said vacuum alone maintains said workpieces together in said workpiece sets; and stacking said workpieces sets into stacks using said transport device, said top workpiece and said bottom workpiece being on opposite ends of each of said workpiece sets and middle workpieces being between said top workpiece and said bottom workpiece, and said patterning forming said holes, when aligned in said workpiece sets, to create continuous openings extending from said top workpiece down to said bottom workpiece and to each of said middle workpieces, such that said vacuum is applied through at least one of said continuous openings to a continuous, unbroken surface of each of said bottom workpiece and said middle workpieces.

18. The method according to claim 17, said patterning being performed such that some of said holes of said individual workpieces within each of said workpiece sets are aligned and others of said holes of said individual workpieces within each of said workpiece sets are not aligned.

19. The method according to claim 17, said top workpiece and said bottom workpiece being on opposite ends of each of said workpiece sets, and said patterning being performed such that said holes of said top workpiece and said bottom workpiece within each of said workpiece sets are not aligned and some of said holes of other workpieces are aligned.

20. The method according to claim 17, different ones of said different holes having different diameters.

* * * * *